US009230551B2

(12) United States Patent
Laaksonen et al.

(10) Patent No.: US 9,230,551 B2
(45) Date of Patent: Jan. 5, 2016

(54) AUDIO ENCODER OR DECODER APPARATUS

(75) Inventors: Lasse Juhani Laaksonen, Tampere (FI); Mikko Tapio Tammi, Tampere (FI); Adriana Vasilache, Tampere (FI); Anssi Sakari Rämö, Tampere (FI)

(73) Assignee: Nokia Technologies Oy, Espoo (FI)

( * ) Notice: Subject to any disclaimer, the term of this patent is extended or adjusted under 35 U.S.C. 154(b) by 213 days.

(21) Appl. No.: 13/880,038

(22) PCT Filed: Oct. 18, 2010

(86) PCT No.: PCT/IB2010/054711

§ 371 (c)(1),
(2), (4) Date: Apr. 17, 2013

(87) PCT Pub. No.: WO2012/052802

PCT Pub. Date: Apr. 26, 2012

(65) Prior Publication Data

US 2013/0226598 A1 Aug. 29, 2013

(51) Int. Cl.
*G10L 19/00* (2013.01)
*G10L 19/02* (2013.01)
(Continued)

(52) U.S. Cl.
CPC ..... *G10L 19/00* (2013.01); *G10L 19/0208* (2013.01); *G10L 19/24* (2013.01); *G10L 21/038* (2013.01)

(58) Field of Classification Search
CPC ..... G10L 19/0208; G10L 21/0316; G10L 21/038; G10L 19/008; G10L 19/24; G10L 19/0212
USPC ..... 381/2, 13, 56; 455/205, 212; 379/21, 379/22.02, 3, 22.01; 725/28; 340/506; 704/205, 229, 230, 262, 203, 219, 704/500–504, 206
See application file for complete search history.

(56) References Cited

U.S. PATENT DOCUMENTS 5,606,618 A * 2/1997 Lokhoff et al. ..... 381/2
8,099,275 B2 * 1/2012 Oshikiri ..... 704/206
(Continued)

FOREIGN PATENT DOCUMENTS

EP 1798724 6/2007
JP 2004004530 1/2004
(Continued)

OTHER PUBLICATIONS

International Search Report received for corresponding Patent Cooperation Treaty Application No. PCT/IB2010/054711, dated Jun. 30, 2011, 5 pages.

*Primary Examiner* — Vijay B Chawan
(74) *Attorney, Agent, or Firm* — Nokia Technologies Oy

(57) ABSTRACT

An apparatus comprising at least one processor and at least one memory including computer program code the at least one memory and the computer program code configured to, with the at least one processor, cause the apparatus at least to perform: determining from an audio signal at least a first part and a second part; encoding the first part of the audio signal with a first encoder for generating a first encoded audio signal; encoding the second part of the audio signal with a second encoder configured to generate a second encoded audio signal comprising for a first section of the second part an indicator to at least part of the first part of the audio signal; and determining the first section of the second part of the audio signal such that the first encoded audio signal and second encoded audio signal is within a defined encoding efficiency parameter.

12 Claims, 7 Drawing Sheets

(51) Int. Cl.
*G10L 19/24* (2013.01)
*G10L 21/038* (2013.01)

(56) References Cited

U.S. PATENT DOCUMENTS

| | | | | |
|---|---|---|---|---|
| 8,190,425 | B2 * | 5/2012 | Mehrotra et al. | 704/203 |
| 2002/0072904 | A1 * | 6/2002 | Chen | 704/230 |
| 2007/0124139 | A1 * | 5/2007 | Chen | 704/219 |
| 2008/0091440 | A1 * | 4/2008 | Oshikiri | 704/501 |
| 2008/0120096 | A1 | 5/2008 | Oh et al. | |
| 2008/0126082 | A1 * | 5/2008 | Ehara et al. | 704/205 |
| 2010/0017199 | A1 * | 1/2010 | Oshikiri et al. | 704/205 |
| 2010/0262421 | A1 * | 10/2010 | Chong et al. | 704/203 |

FOREIGN PATENT DOCUMENTS

| | | |
|---|---|---|
| WO | 2007052088 | 5/2007 |
| WO | 2009059631 | 5/2009 |
| WO | 2009113316 | 9/2009 |

* cited by examiner

AUDIO ENCODER OR DECODER APPARATUS

RELATED APPLICATION

This application was originally filed as PCT Application No. PCT/IB2010/054711 filed Oct. 18, 2010.

FIELD OF THE APPLICATION

The present invention relates to coding, and in particular, but not exclusively to speech or audio coding.

BACKGROUND OF THE APPLICATION

Audio signals, like speech or music, are encoded for example to enable efficient transmission or storage of the audio signals. A high compression ratio enables the storage of the data with the same storage capacity or transmitting the signal more efficiently through a communication channel, which in turn can provide the service for more simultaneous users. On the other hand, a high compression ratio may lead to perceived degradation of the compressed audio. The target of audio coding is in general thus to maximize the audio quality at a given compression ratio, or to maintain a given audio quality with as good a compression ratio as possible.

Audio encoders and decoders are used to represent audio based signals, such as music and ambient sounds (which in speech coding terms can be called background noise). These types of coders typically do not utilise a speech model for the coding process, rather they use processes for representing all types of audio signals, including speech.

Speech encoders and decoders (codecs) are usually optimised for speech signals, and can operate at either a fixed or variable bit rate.

An audio codec can also be configured to operate with varying bit rates. At lower bit rates, such an audio codec may work with speech signals at a coding rate equivalent to a pure speech codec. At higher bit rates, the audio codec may code any signal including music, background noise and speech, with higher quality and performance.

In some audio codecs the input signal is divided into a limited number of bands. Furthermore some codecs use the correlation between the low and high frequency bands or regions of an audio signal to improve the coding efficiency of the codecs.

As typically the higher frequency bands of the spectrum are generally quite similar to the lower frequency bands some codecs encode only the lower frequency bands and reproduce the upper frequency bands as a scaled lower frequency band copy. Thus by only using a small amount of additional control information considerable savings can be achieved in the total bit rate of the codec.

For example, if we divide a full-band (20-kHz bandwidth) audio signal equally into two frequency regions, it is often the case that the higher band is quite similar to the lower band. Since the higher frequencies are not generally as perceptually sensitive to coding errors (introduced by the compression) as the low-frequency part of the signal, a lower bit rate (and a higher compression ratio) can be used for the high-frequency content than the corresponding low-frequency content. In addition, the high-frequency coding can be at least partially based on the low-frequency coding. This gives rise to so-called bandwidth extension methods, which are commonly employed in modern, low-rate audio coding.

New speech and audio coding for the next generation telecommunication systems are in development or planning and have been currently referred to as EVS (Enhanced Voice Service) codec for EPS (Evolved Packet System) or LTE (Long Term Evolution) telecommunication systems. The EVS codec is envisioned to provide several different levels of quality (including considerations such as bit rate, audio bandwidth, algorithmic delay, number of channels, interoperability with existing standards, etc.). Of particular interest is a low bit rate super-wideband (SWB, 14-kHz bandwidth) coding that is interoperable with the current 3GPP wideband (WB, 7-kHz bandwidth) standard AMR-WB (Adaptive Multi-Rate Wide Band) codecs. Potential operating points are expected to include SWB speech at about 16 kbps implementing interoperability with AMR-WB 12.65 kbps, as well as SWB speech at 12.65 kbps based on a WB core codec possibly operating at about 10-11 kbps. Such bit rate targets indicate a need for a very low bit rate SWB extension of WB speech and audio codecs. This SWB extension should significantly improve the user experience (i.e. provide high quality) while having low complexity and low delay.

It is understood that a low estimate for a required bit rate of the SWB extension will be about 1.0-1.6 kbps. For example, a total bit rate of 12.65 kbps based on a 11 kbps WB core coding suggests that the highest possible bit rate for the SWB part would be 1.65 kbps. However this required extension bit rate may be decreased perhaps as low as 1.0 kbps.

Conventional SWB extension methods based on the technology described by Tammi et al such as "Scalable Super-wideband Extension for Wideband Coding," as discussed in ICASSP 2009, Taipei, Taiwan, 2009 operating around 2.0 kbps can spend about 50% or around 1.0 kbps transmitting the subband indices. Thus to reach 1.5 kbps or even 1.0 kbps and still be able to provide a suitable performance is problematic.

One approach to reduce the bits sent transmitting index values is to not transmit an optimal index at all for one or more of the subbands but to use a fixed point (a fixed, predetermined index) for the subband replication step.

The fixed-index solution however although reducing the bits sent is problematic and produces poor quality audio signals because it can produce unwanted periodicity in the highest frequencies which are heard as "chirping" sounds that clearly are not part of the original signal and can be very annoying.

SUMMARY OF THE APPLICATION

This invention proceeds from the consideration that the currently proposed codecs lack flexibility with respect to being able to code efficient and accurate approximations to the signals.

Embodiments of the present application aim to address the above problem.

There is provided according to a first aspect a method comprising: determining from an audio signal at least a first part and a second part; encoding the first part of the audio signal with a first encoder for generating a first encoded audio signal; encoding the second part of the audio signal with a second encoder configured to generate a second encoded audio signal comprising for a first section of the second part an indicator to at least part of the first part of the audio signal; and determining the first section of the second part of the audio signal such that the first encoded audio signal and second encoded audio signal is within a defined encoding efficiency parameter.

The encoding efficiency parameter may comprise at least one of: a bitrate; a bandwidth; and an encoded audio signal size to audio signal size ratio.

The method may further comprise combining the first encoded audio signal and the second encoded audio signal.

The method may further comprise storing a combined first encoded audio signal and second encoded audio signal.

The method may further comprise transmitting a combined first encoded audio signal and second encoded audio signal.

The second encoded audio signal may further comprise at least one scaling parameter configured to define a scaling between a section of the second part of the audio signal and a section of the first part of the audio signal, wherein the section of the first part of the audio signal is the first part of the audio signal associated with the indicator for the first section of the second part of the audio signal.

The at least one scaling parameter may comprise at least one of: a linear domain scaling parameter; and a logarithmic domain scaling parameter.

The method may further comprise determining a reference section of the second part of the audio signal, wherein the first section of the second part of the audio signal may be selected as the reference section.

Determining a reference section may comprise: dividing the second part of the audio signal into a plurality of sections; determining for each of the plurality of sections a cross-correlation value between each combination of the plurality of sections; and selecting as the reference section the section with the largest average cross-correlation value.

Determining from an audio signal at least a first part and a second part may comprise: filtering an audio signal into a first part representing a lower frequency region and a second part representing a higher frequency region.

According to a second aspect there is provided an apparatus comprising at least one processor and at least one memory including computer program code the at least one memory and the computer program code configured to, with the at least one processor, cause the apparatus at least to perform: determining from an audio signal at least a first part and a second part; encoding the first part of the audio signal with a first encoder for generating a first encoded audio signal; encoding the second part of the audio signal with a second encoder configured to generate a second encoded audio signal comprising for a first section of the second part an indicator to at least part of the first part of the audio signal; and determining the first section of the second part of the audio signal such that the first encoded audio signal and second encoded audio signal is within a defined encoding efficiency parameter.

The encoding efficiency parameter may comprise at least one of: a bitrate; a bandwidth; and an encoded audio signal size to audio signal size ratio.

The apparatus may be further configured to perform combining the first encoded audio signal and the second encoded audio signal.

The apparatus may be further configured to perform storing a combined first encoded audio signal and second encoded audio signal.

The apparatus may be further configured to perform transmitting a combined first encoded audio signal and second encoded audio signal.

The second encoded audio signal may further comprise at least one scaling parameter configured to define a scaling between a section of the second part of the audio signal and a section of the first part of the audio signal, wherein the section of the first part of the audio signal may be the first part of the audio signal associated with the indicator for the first section of the second part of the audio signal.

The at least one scaling parameter may comprise at least one of: a linear domain scaling parameter; and a logarithmic domain scaling parameter.

The apparatus may be further configured to perform determining a reference section of the second part of the audio signal, wherein the first section of the second part of the audio signal is selected as the reference section.

Determining a reference section may further cause the apparatus to perform: dividing the second part of the audio signal into a plurality of sections; determining for each of the plurality of sections a cross-correlation value between each combination of the plurality of sections; and selecting as the reference section the section with the largest average cross-correlation value.

Determining from an audio signal at least a first part and a second part may further cause the apparatus to perform: filtering an audio signal into a first part representing a lower frequency region and a second part representing a higher frequency region.

According to a third aspect there is provided a method comprising: decoding from a first part of an encoded audio signal a first audio signal; decoding from a second part of the encoded audio signal at least one indicator referencing at least a part of the first audio signal for generating a second audio signal; and generating at least one further indicator dependent on at least one indicator, the at least one further indicator referencing at least a part of the first audio signal for generating a third audio signal; and combining the first, second and third audio signals to generate a decoded audio signal.

Generating at least one further indicator from at least one indicator may comprise: determining a further indicator value dependent on a combination indicator value from at least two indicator values decoded from the second part of the encoded signal.

Generating at least one further indicator from at least one indicator may further comprise: determining a initial further indicator value; and determining a further indicator value by combining the initial further indicator value with the combination indicator value.

Determining an initial further indicator value may comprise: decoding from a reference second part of the encoded audio signal a reference indicator value; and determining the initial further indicator value as the reference indicator value.

The at least one initial further indicator value may be at least one of: a static value; and an adaptive value.

Determining a combination indicator value may comprise generating an average value of the at least two indicator values decoded from the second part of the encoded signal.

Determining a combination indicator value may comprise generating a weighted averaging of the at least two indicator values decoded from the second part of the encoded signal.

The method may further comprise: decoding from the second part of the encoded audio signal at least one scaling factor, wherein generating the second audio signal comprises: selecting at least one part of the first audio signal dependent on the at least one indicator value; and applying the at least one scaling factor to the at least one part of the first audio signal selected.

The method may further comprise: decoding from the second part of the encoded audio signal at least one further scaling factor, wherein generating the third audio signal comprises: selecting at least one part of the first audio signal dependent on the at least one further indicator value; and applying the at least one further scaling factor to the at least one part of the first audio signal selected dependent on the at least one further indicator value.

The method may further comprise receiving an encoded audio signal.

According to a fourth aspect there is provided an apparatus comprising at least one processor and at least one memory including computer program code the at least one memory and the computer program code configured to, with the at least one processor, cause the apparatus at least to perform: decoding from a first part of an encoded audio signal a first audio signal; decoding from a second part of the encoded audio signal at least one indicator referencing at least a part of the first audio signal for generating a second audio signal; generating at least one further indicator dependent on at least one indicator, the at least one further indicator referencing at least a part of the first audio signal for generating a third audio signal; and combining the first, second and third audio signals to generate a decoded audio signal.

Generating at least one further indicator from at least one indicator may further cause the apparatus to perform determining a further indicator value dependent on a combination indicator value from at least two indicator values decoded from the second part of the encoded signal.

Generating at least one further indicator from at least one indicator may further cause the apparatus to perform: determining a initial further indicator value; determining a further indicator value by combining the initial further indicator value with the combination indicator value.

Determining an initial further indicator value further may cause the apparatus to perform: decoding from a reference second part of the encoded audio signal a reference indicator value; and determining the initial further indicator value as the reference indicator value.

The at least one initial further indicator value may be at least one of: a static value; and an adaptive value.

Determining a combination indicator value may cause the apparatus to perform generating an average value of the at least two indicator values decoded from the second part of the encoded signal.

Determining a combination indicator value may cause the apparatus to perform generating a weighted averaging of the at least two indicator values decoded from the second part of the encoded signal.

The apparatus may further be caused to perform: decoding from the second part of the encoded audio signal at least one scaling factor, wherein generating the second audio signal comprises: selecting at least one part of the first audio signal dependent on the at least one indicator value; and applying the at least one scaling factor to the at least one part of the first audio signal selected.

The apparatus may further be caused to perform: decoding from the second part of the encoded audio signal at least one further scaling factor, wherein generating the third audio signal comprises: selecting at least one part of the first audio signal dependent on the at least one further indicator value; and applying the at least one further scaling factor to the at least one part of the first audio signal selected dependent on the at least one further indicator value.

The apparatus may further be caused to perform receiving an encoded audio signal.

According to a fifth aspect there is provided an apparatus comprising: a signal divider configured to determine from an audio signal at least a first part and a second part; a first encoder configured to encode the first part of the audio signal for generating a first encoded audio signal; a second encoder configured to encode the second part of the audio signal to generate a second encoded audio signal comprising for a first section of the second part an indicator to at least part of the first part of the audio signal; and determining the first section of the second part of the audio signal such that the first encoded audio signal and second encoded audio signal is within a defined encoding efficiency parameter.

The encoding efficiency parameter may comprise at least one of: a bitrate; a bandwidth; and an encoded audio signal size to audio signal size ratio.

The apparatus may further comprise a multiplexer configured to combine the first encoded audio signal and the second encoded audio signal.

The apparatus may further comprise data storage configured to store a combined first encoded audio signal and second encoded audio signal.

The apparatus may be further comprise a transmitter configured to transmit a combined first encoded audio signal and second encoded audio signal.

The second encoder may further comprise a scaling determiner configured to determine at least one scaling parameter configured to define a scaling between a section of the second part of the audio signal and a section of the first part of the audio signal, wherein the section of the first part of the audio signal may be the first part of the audio signal associated with the indicator for the first section of the second part of the audio signal.

The at least one scaling parameter may comprise at least one of: a linear domain scaling parameter; and a logarithmic domain scaling parameter.

The apparatus may further comprise a reference determiner to determine a reference section of the second part of the audio signal, wherein the first section of the second part of the audio signal is selected as the reference section.

The reference determiner may further comprise: a section divider configured to divide the second part of the audio signal into a plurality of sections; a cross-correlator configured to determine for each of the plurality of sections a cross-correlation value between each combination of the plurality of sections; and a selector configured to select as the reference section the section with the largest average cross-correlation value.

The determiner may comprise: a filter configured to filter the audio signal into a first part representing a lower frequency region and a second part representing a higher frequency region.

According to a sixth aspect there is provided an apparatus comprising: a first decoder configured to decode from a first part of an encoded audio signal a first audio signal; a second decoder configured to decode from a second part of the encoded audio signal at least one indicator referencing at least a part of the first audio signal for generating a second audio signal; a indicator generator configured to generate at least one further indicator dependent on at least one indicator, the at least one further indicator referencing at least a part of the first audio signal for generating a third audio signal; and a combiner configured to combine the first, second and third audio signals to generate a decoded audio signal.

The indicator generator may comprise an indicator value determiner configured to determine the further indicator value dependent on a combination indicator value from at least two indicator values decoded from the second part of the encoded signal.

The indicator generator may comprise: an initial value determiner configured to determine an initial further indicator value; an indicator value combiner configured to determine a further indicator value by combining the initial further indicator value with the combination indicator value.

The initial value determiner may comprise: a reference indicator decoder configured to decode from a reference second part of the encoded audio signal a reference indicator value; and initial value selector configured to determine the initial further indicator value as the reference indicator value.

The at least one initial further indicator value may be at least one of: a static value; and an adaptive value.

The indicator value determiner may comprise an averager configured to generate an average value of the at least two indicator values decoded from the second part of the encoded signal.

The indicator value determiner may comprise a weighted averager configured to generate a weighted averaging of the at least two indicator values decoded from the second part of the encoded signal.

The second decoder may further comprise a scaling factor determiner configured to determine from the second part of the encoded audio signal at least one scaling factor; and a signal selector configured to select at least one part of the first audio signal dependent on the at least one indicator value; and signal scaler configured to apply the at least one scaling factor to the at least one part of the first audio signal selected.

The second decoder may further comprise a third signal scaling factor determiner configured to decode from the second part of the encoded audio signal at least one further scaling factor, a third signal selector configured to select at least one part of the first audio signal dependent on the at least one further indicator value; and a third signal scaler configured to apply the at least one further scaling factor to the at least one part of the first audio signal selected dependent on the at least one further indicator value.

The apparatus may comprise a receiver configured to receive an encoded audio signal.

According to a seventh aspect there is provided an apparatus comprising: means for determining from an audio signal at least a first part and a second part; first encoding means for encoding the first part of the audio signal for generating a first encoded audio signal; second encoding means for encoding the second part of the audio signal to generate a second encoded audio signal comprising for a first section of the second part an indicator to at least part of the first part of the audio signal; and processing means for determining the first section of the second part of the audio signal such that the first encoded audio signal and second encoded audio signal is within a defined encoding efficiency parameter.

The encoding efficiency parameter may comprise at least one of: a bitrate; a bandwidth; and an encoded audio signal size to audio signal size ratio.

The apparatus may further comprise combining means for combining the first encoded audio signal and the second encoded audio signal.

The apparatus may further comprise data storage means for storing a combined first encoded audio signal and second encoded audio signal.

The apparatus may further comprise transmitting means for transmitting a combined first encoded audio signal and second encoded audio signal.

The second encoding means may further comprise a scaling means for determining at least one scaling parameter configured to define a scaling between a section of the second part of the audio signal and a section of the first part of the audio signal, wherein the section of the first part of the audio signal may be the first part of the audio signal associated with the indicator for the first section of the second part of the audio signal.

The at least one scaling parameter may comprise at least one of: a linear domain scaling parameter; and a logarithmic domain scaling parameter.

The apparatus may further comprise reference means for determining a reference section of the second part of the audio signal, wherein the first section of the second part of the audio signal is selected as the reference section.

The reference means may further comprise: dividing means for dividing the second part of the audio signal into a plurality of sections; processing means for determining for each of the plurality of sections a cross-correlation value between each combination of the plurality of sections; and selection means for selecting as the reference section the section with the largest average cross-correlation value.

The dividing means may comprise: filtering means configured to filter the audio signal into a first part representing a lower frequency region and a second part representing a higher frequency region.

According to an eighth aspect there is provided an apparatus comprising: first decoding means configured to decode from a first part of an encoded audio signal a first audio signal; second decoding means configured to decode from a second part of the encoded audio signal at least one indicator referencing at least a part of the first audio signal for generating a second audio signal; a indicator generating means configured to generate at least one further indicator dependent on at least one indicator, the at least one further indicator referencing at least a part of the first audio signal for generating a third audio signal; and combining means configured to combine the first, second and third audio signals to generate a decoded audio signal.

The indicator generating means may comprise a value determiner means configured to determine the further indicator value dependent on a combination indicator value from at least two indicator values decoded from the second part of the encoded signal.

The indicator generating means may comprise: an initial determiner means for determining an initial further indicator value; combiner means for determining the further indicator value by combining the initial further indicator value with the combination indicator value.

The initial determiner means may comprise: reference value means for decoding from a reference second part of the encoded audio signal a reference indicator value; and initial value selector means for determining the initial further indicator value as the reference indicator value.

The at least one initial further indicator value may be at least one of: a static value; and an adaptive value.

The indicator generating means may comprise indicator processing means for generating an average value of the at least two indicator values decoded from the second part of the encoded signal.

The indicator generating means may comprise an weighted indicator means for generating a weighted averaging of the at least two indicator values decoded from the second part of the encoded signal.

The second decoding means may further comprise a scaling factor determiner configured to determine from the second part of the encoded audio signal at least one scaling factor; and a signal selector configured to select at least one part of the first audio signal dependent on the at least one indicator value; and signal scaler configured to apply the at least one scaling factor to the at least one part of the first audio signal selected.

The second decoding means may further comprise a third signal scaling factor determiner configured to decode from the second part of the encoded audio signal at least one further scaling factor, a third signal selector configured to select at least one part of the first audio signal dependent on the at least one further indicator value; and a third signal scaler configured to apply the at least one further scaling factor to the at least one part of the first audio signal selected dependent on the at least one further indicator value.

The apparatus may comprise receiving means configured to receive an encoded audio signal.

An electronic device may comprise apparatus as described above.

A chipset may comprise apparatus as described above.

BRIEF DESCRIPTION OF DRAWINGS

For better understanding of the present invention, reference will now be made by way of example to the accompanying drawings in which.

DESCRIPTION OF SOME EMBODIMENTS OF THE APPLICATION

Figure 1:
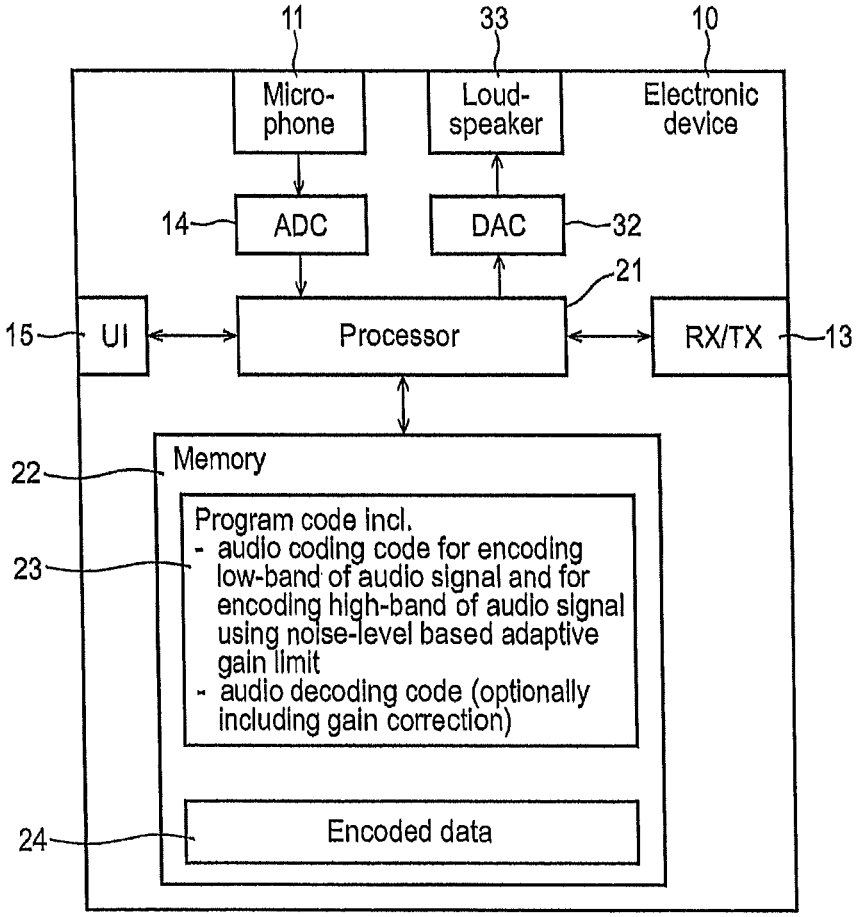
FIG. 1 shows schematically an apparatus suitable for employing some embodiments of the application.

The following describes in more detail possible codec mechanisms for the provision of layered or scalable variable rate audio codecs. In this regard reference is first made to FIG. 1 which shows a schematic block diagram of an exemplary electronic device or apparatus 10, which may incorporate a codec according to embodiments of the application.

The apparatus 10 may for example be a mobile terminal or user equipment of a wireless communication system. In other embodiments the apparatus 10 may be an audio-video device such as video camera, a Television (TV) receiver, audio recorder or audio player such as a mp3 recorder/player, a media recorder (also known as a mp4 recorder/player), or any computer suitable for the processing of audio signals.

The apparatus 10 in some embodiments comprises a microphone 11, which is linked via an analogue-to-digital converter (ADC) 14 to a processor 21. The processor 21 is further linked via a digital-to-analogue (DAC) converter 32 to loudspeakers 33. The processor 21 is further linked to a transceiver (RX/TX) 13, to a user interface (UI) 15 and to a memory 22.

The processor 21 may be configured to execute various program codes. The implemented program codes in some embodiments comprise an audio encoding code for encoding a lower frequency band of an audio signal and a higher frequency band of an audio signal. The implemented program codes 23 in some embodiments further comprise an audio decoding code. The implemented program codes 23 can in some embodiments be stored for example in the memory 22 for retrieval by the processor 21 whenever needed. The memory 22 could further provide a section 24 for storing data, for example data that has been encoded in accordance with embodiments of the application.

The encoding and decoding code in embodiments can be implemented in hardware or firmware.

The user interface 15 enables a user to input commands to the apparatus 10, for example via a keypad, and/or to obtain information from the apparatus 10, for example via a display. In some embodiments a touch screen may provide both input and output functions for the user interface. The apparatus 10 in some embodiments comprises a transceiver 13 suitable for enabling communication with other apparatus, for example via a wireless communication network.

It is to be understood again that the structure of the apparatus 10 could be supplemented and varied in many ways.

A user of the apparatus 10 for example can use the microphone 11 for inputting speech or other audio signals that are to be transmitted to some other apparatus or that are to be stored in the data section 24 of the memory 22. A corresponding application in some embodiments can be activated to this end by the user via the user interface 15. This application in these embodiments can be performed by the processor 21, causes the processor 21 to execute the encoding code stored in the memory 22.

The analogue-to-digital converter (ADC) 14 in some embodiments converts the input analogue audio signal into a digital audio signal and provides the digital audio signal to the processor 21. In some embodiments the microphone 11 can comprise an integrated microphone and ADC function and provide digital audio signals directly to the processor for processing.

The processor 21 in such embodiments then can process the digital audio signal in the same way as described with reference to FIGS. 3 to 5.

The resulting bit stream can in some embodiments be provided to the transceiver 13 for transmission to another apparatus. Alternatively, the coded audio data in some embodiments can be stored in the data section 24 of the memory 22, for instance for a later transmission or for a later presentation by the same apparatus 10.

The apparatus 10 in some embodiments can also receive a bit stream with correspondingly encoded data from another apparatus via the transceiver 13. In this example, the processor 21 may execute the decoding program code stored in the memory 22. The processor 21 in such embodiments decodes the received data, and provides the decoded data to a digital-to-analogue converter 32. The digital-to-analogue converter 32 converts the digital decoded data into analogue audio data and can in some embodiments output the analogue audio via the loudspeakers 33. Execution of the decoding program code in some embodiments can be triggered as well by an application called by the user via the user interface 15.

The received encoded data in some embodiments can also be stored instead of an immediate presentation via the loudspeakers 33 in the data section 24 of the memory 22, for instance for later decoding and presentation or decoding and forwarding to still another apparatus.

Figure 3:
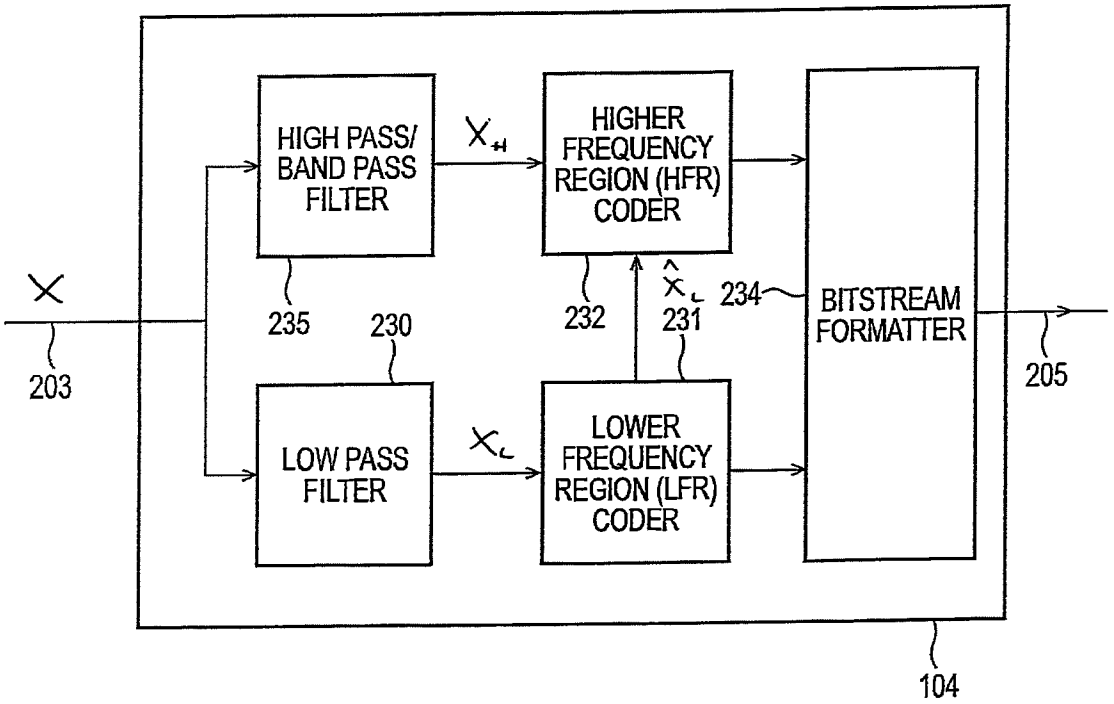
FIG. 3 shows schematically an encoder part of the audio codec system shown in FIG. 2 according to some embodiments of the application.
Figure 4:
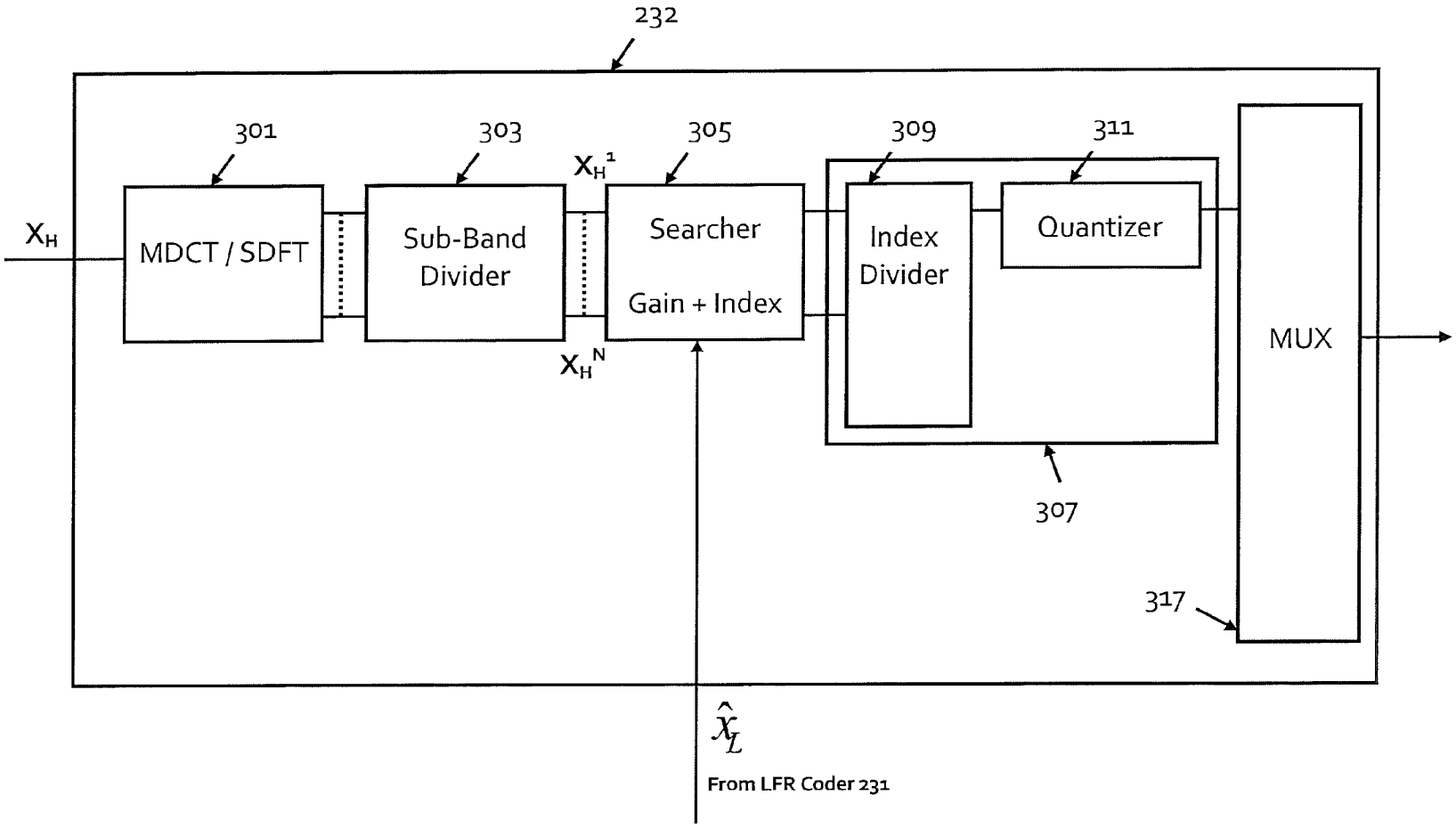
FIG. 4 shows a schematic view of the higher frequency region encoder portion of the encoder as shown in FIG. 3 according to some embodiments of the application.
Figure 5:
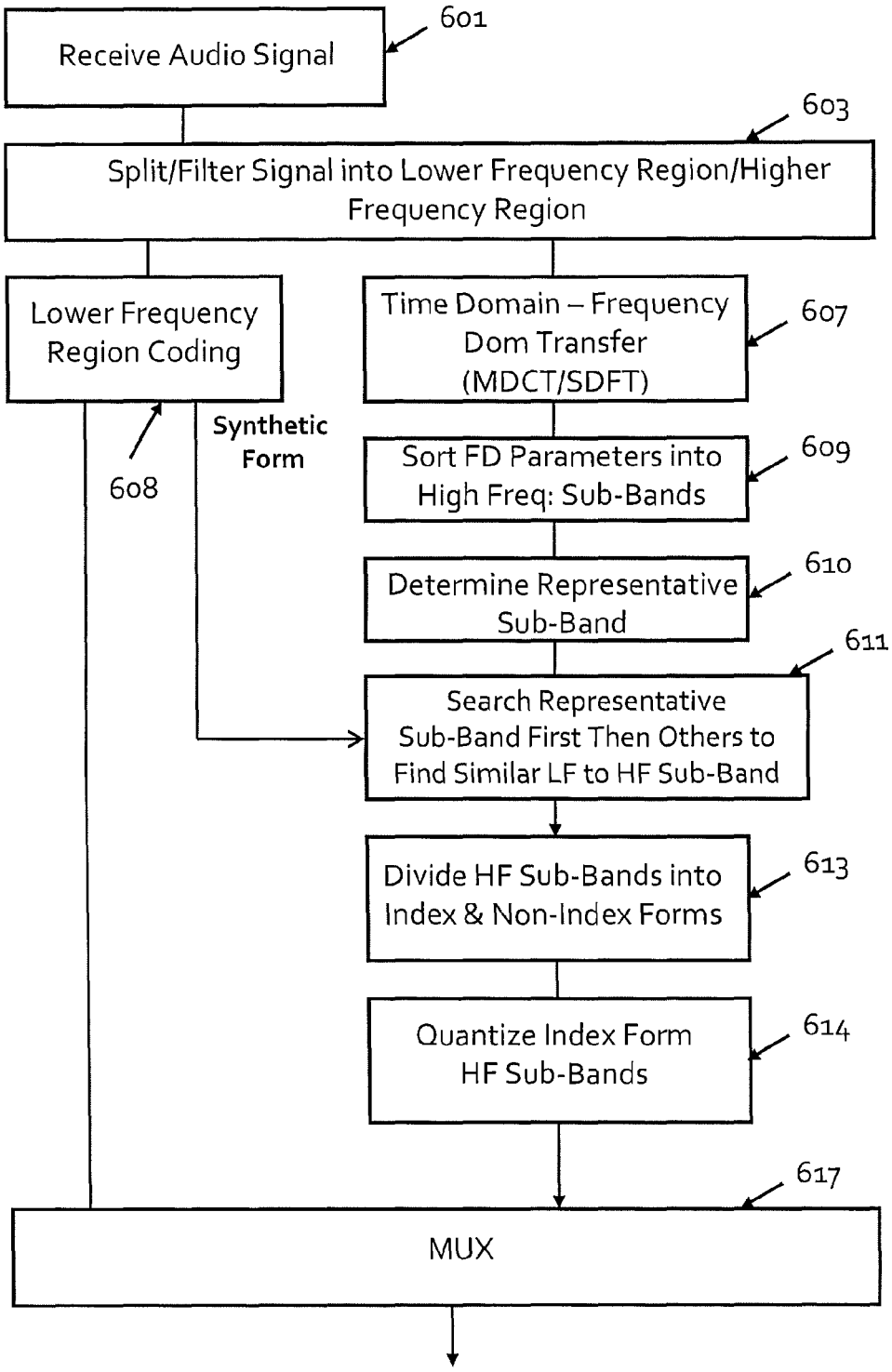
FIG. 5 shows a flow diagram illustrating the operation the audio encoder as shown in FIGS. 3 and 4 according to some embodiments of the application.
Figure 6:
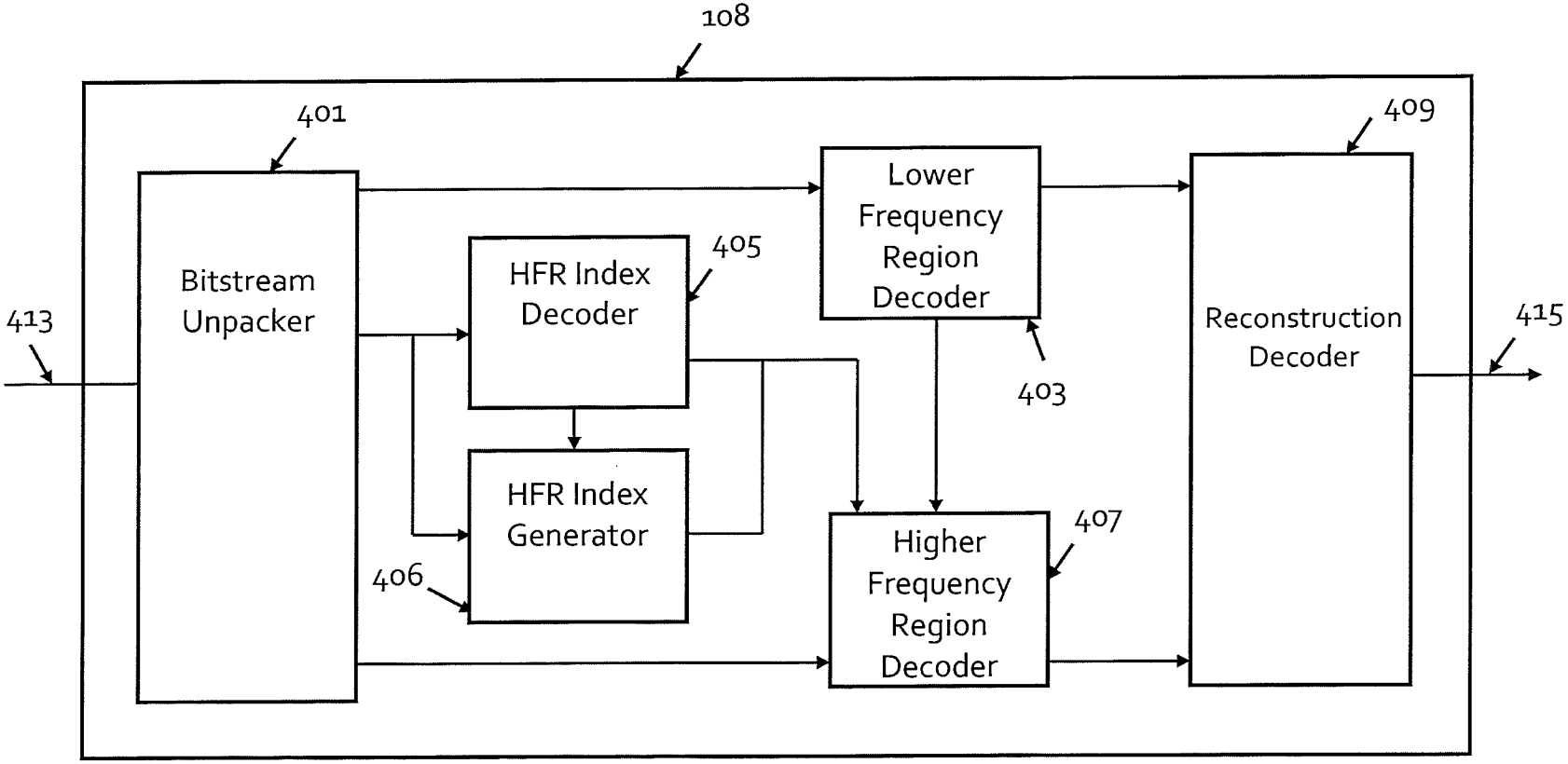
FIG. 6 shows schematically a decoder part of the audio codec system as shown in FIG. 2.
Figure 7:
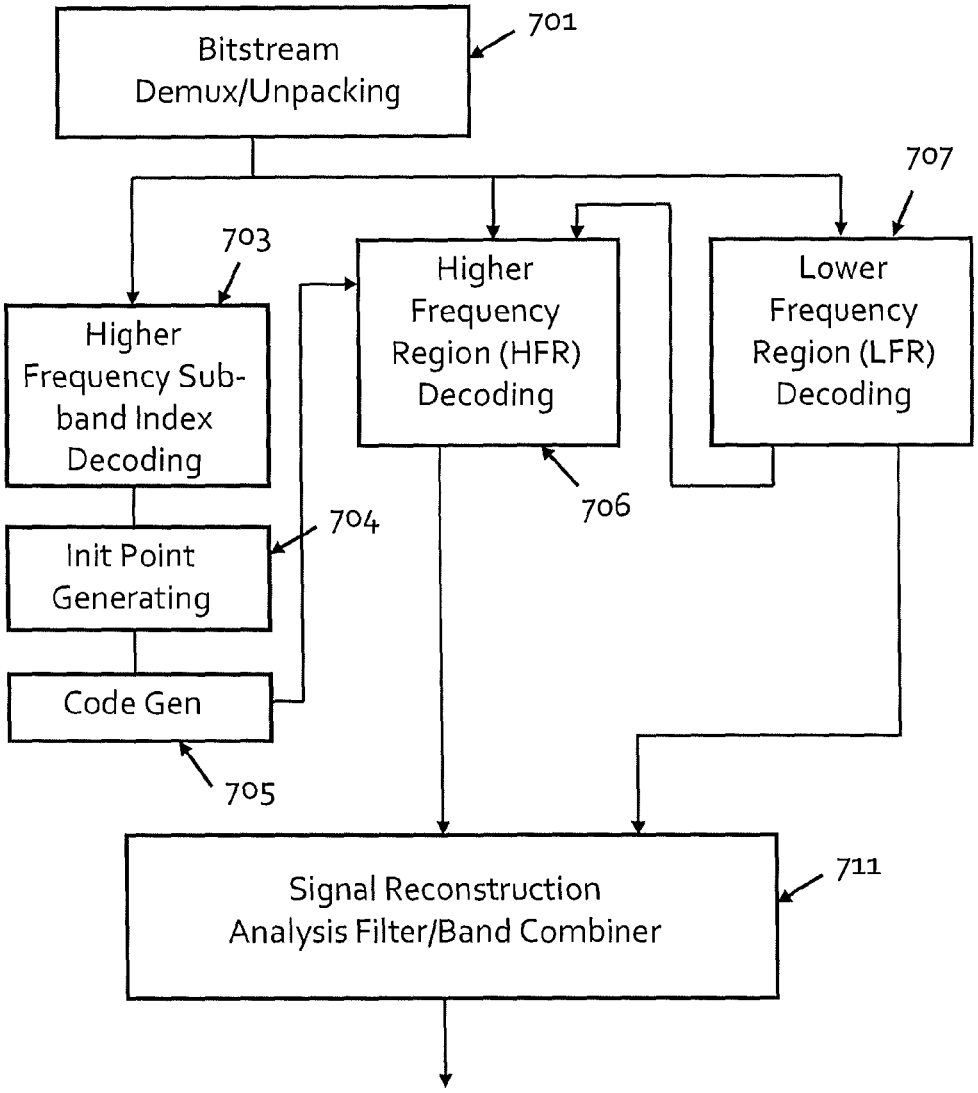
FIG. 7 shows a flow diagram illustrating the operation the audio decoder as shown in FIG. 6 according to some embodiments of the application.

It would be appreciated that the schematic structures described in FIGS. 3 to 4 and 6 and the method steps shown in FIGS. 5 and 7 represent only a part of the operation of an audio codec as exemplarily shown implemented in the apparatus shown in FIG. 1.

Figure 2:
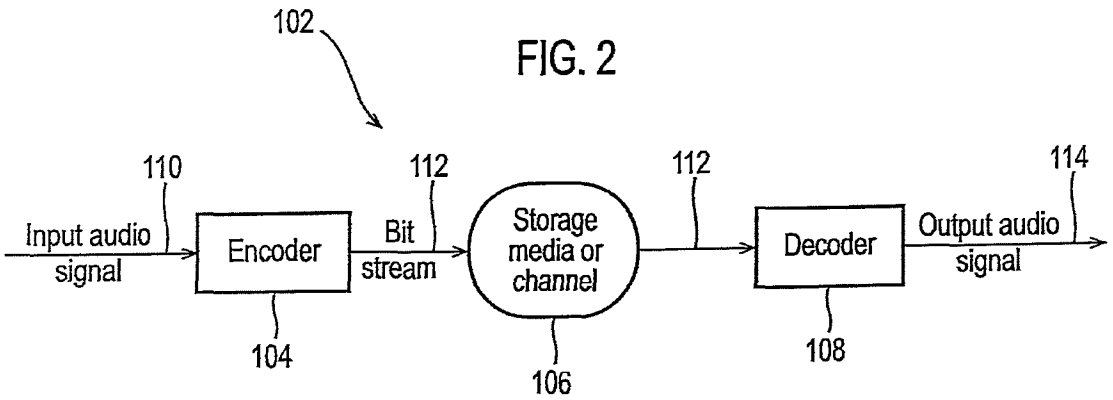
FIG. 2 shows schematically an audio codec system suitable employing some embodiments of the application.

The general operation of audio codecs as employed by embodiments of the application is shown in FIG. 2. General audio coding/decoding systems comprise both an encoder and a decoder, as illustrated schematically in FIG. 2. However, it would be understood that embodiments of the application can implement one of either the encoder or decoder, or both the encoder and decoder. Illustrated by FIG. 2 is a system 102 with an encoder 104, a storage or media channel 106 and a decoder 108. It would be understood that as described above some embodiments of the apparatus 10 can comprise or implement one of the encoder 104 or decoder 108 or both the encoder 104 and decoder 108.

The encoder 104 compresses an input audio signal 110 producing a bit stream 112, which in some embodiments can be stored or transmitted through a media channel 106. The bit stream 112 can be received within the decoder 108. The decoder 108 decompresses the bit stream 112 and produces an output audio signal 114. The bit rate of the bit stream 112 and the quality of the output audio signal 114 in relation to the input signal 110 are the main features which define the performance of the coding system 102.

FIG. 3 shows schematically an encoder 104 according to some embodiments of the application. The encoder 104 in such embodiments comprises an input 203 arranged to receive an audio signal. The input 203 is connected to a low pass filter 230 and high pass/band pass filter 235. The low pass filter 230 furthermore outputs a signal to the lower frequency region (LFR) coder (otherwise known as the core codec) 231. The lower frequency region coder 231 is configured to output signals to the higher frequency region (HFR) coder 232. The high pass/band pass filter 235 is connected to the HFR coder 232. The LFR coder 231 and the HFR coder 232 are configured to output signals to the bitstream formatter 234 (which in some embodiments of the invention is also known as the bitstream multiplexer). The bitstream formatter 234 is configured to output the output bitstream 112 via the output 205.

In some embodiments of the invention the high pass/band pass filter 235 may be optional, and the audio signal passed directly to the HFR coder 232. In some further embodiments the operation of the low pass filter 230 and high pass filter 235 can be implemented as a quadrature mirror filter (QMF) configuration which outputs a lower frequency component to the LFR coder 231 and a higher frequency component to the HFR coder 232.

The operation of these components is described in more detail with reference to the flow chart, FIG. 5, showing the operation of the coder 104.

The audio signal is received by the coder 104. In some embodiments the audio signal is a digitally sampled signal. In some other embodiments the audio input may be an analogue audio signal, for example from a microphone, which is analogue to digitally (A/D) converted in the coder 104. In some further embodiments the audio input is converted from a pulse code modulation digital signal to amplitude modulation digital signal.

The receiving of the audio signal is shown in FIG. 5 by step 601.

The low pass filter 230 and the high pass/band pass filter 235 receive the audio signal and define a cut-off frequency about which the input signal 110 is filtered. The received audio signal frequencies below the cut-off frequency are passed by the low pass filter 230 to the lower frequency region (LFR) coder 231. The received audio signal frequencies above the cut-off frequency are passed by the high pass filter 235 to the higher frequency region (HFR) coder 232. In some embodiments of the invention the signal is optionally down sampled in order to further improve the coding efficiency of the lower frequency region coder 231. In other words in some embodiments there can be means for determining from an audio signal at least a first part and a second part. The dividing means may in some embodiments comprise: filtering means configured to filter the audio signal into a first part representing a lower frequency region and a second part representing a higher frequency region.

The splitting or filtering of the signal into lower frequency regions and higher frequency regions is shown in FIG. 5 by step 603.

The LFR coder 231 receives the low frequency (and optionally down sampled) audio signal and applies a suitable low frequency coding upon the signal. In a first embodiment of the invention the low frequency coder 231 applies a quantization and Huffman coding with 32 low frequency sub-bands. The input signal 110 in such embodiments can be divided into sub-bands using an analysis filter bank structure. Each sub-band in some embodiments can be quantized and coded utilizing the information provided by a psychoacoustic model. The quantization settings as well as the coding scheme can in some embodiments be dictated by the psychoacoustic model applied. The quantized, coded information is then in such embodiments sent to the bit stream formatter 234 for creating a bit stream 112.

Furthermore the LFR coder 231 in some embodiments applies an inverse coding to the coded LFR signals to generate a synthetic LFR signal. In some embodiments the LFR coder 231 can furthermore convert the synthetic lower frequency content using a modified discrete cosine transform (MDCT) to produce frequency domain realizations of the synthetic LFR signal. These frequency domain realizations $\hat{X}_L$ are in some embodiments passed to the HFR coder 232. In other words in at least one embodiment there comprises first encoding means for encoding the first part of the audio signal for generating a first encoded audio signal.

This lower frequency region coding is shown in FIG. 5 by step 606.

In some other embodiments other low frequency codecs may be employed in order to generate the core coding output which is output to the bitstream formatter 234 and used to generate the synthetic LFR signal and frequency domain LFR signal. Examples of these further embodiment low frequency codecs include but are not limited to advanced audio coding (MC), MPEG layer 3 (MP3), the ITU-T G.718, and ITU-T G.729.1.

Where the lower frequency region coder 231 does not effectively output a frequency domain synthetic output as part of the coding process the low frequency region (LFR) coder 231 may furthermore comprise a low frequency decoder and frequency domain converter (not shown in FIG. 3) to generate a synthetic reproduction of the low frequency signal. These can in embodiments be converted into frequency domain representations and, if needed, partitioned into a series of low frequency sub-bands which are sent to the HFR coder 232.

This allows in some embodiments the choice of the lower frequency region coder 231 to be made from a wide range of possible coder/decoders and as such the embodiments are not limited to a specific low frequency or core code algorithm which produces frequency domain information as part of the output.

The higher frequency region (HFR) coder 232 is schematically shown in further detail in FIG. 4.

The higher frequency region coder 232 receives the signal from the high pass/band pass filter 235. In some embodiments the HFR coder 232 comprises a modified discrete cosine transform (MDCT)/shifted discrete Fourier transform (SDFT) processor 301 configured to receive the signal from the high pass/band pass filter 235 and transform a time domain signal into a frequency domain signal. It would be understood that any suitable time domain to frequency domain converter may be employed.

The frequency domain representations of the higher frequency components can in some embodiments be output to a sub-band divider 303.

The operation of time domain to frequency domain transformation is shown in FIG. 5 by step 607.

In some embodiments the HFR coder 232 further comprises a sub-band divider 303. The sub-band divider 303 in such embodiments receives the output from the MDCT/SDFT and is configured to divide the frequency domain representations of the higher frequency audio signal into short frequency sub-bands. These frequency sub-bands in some embodiments can be of the order of 500-800 Hz wide. In some embodiments the frequency sub-bands have non-equal bandwidths.

In some embodiments, the frequency sub-band bandwidth is constant, in other words does not change from frame to frame. In some other embodiments, the frequency sub-band bandwidth is not constant and a frequency sub-band may have bandwidth which changes over time.

In some embodiments, this variable frequency sub-band bandwidth allocation may be determined based on a psychoacoustic modelling of the audio signal. These frequency sub-bands may furthermore be in various embodiments successive (in other words, one after another and producing a continuous spectral realisation) or partially overlapping for example for the purpose of smoothing the spectral shape over successive frequency sub-bands.

The sub-band frequency domain representations $X_H^1 \ldots X_H^n$ can be passed in some embodiments of the application to the sub-band searcher 305.

The reference means may thus in some embodiments further comprise: dividing means for dividing the second part of the audio signal into a plurality of sections; processing means for determining for each of the plurality of sections a cross-correlation value between each combination of the plurality of sections; and selection means for selecting as the reference section the section with the largest average cross-correlation value.

The frequency domain sub-band organisation operation is shown in FIG. 5 by step 609.

In some embodiments the higher frequency region coder 232 comprises a searcher 305, which having received the higher frequency sub-band representations $X_H^1 \ldots X_H^n$, and the synthetic lower frequency representations $\hat{X}_L$, is configured to search for each of the higher frequency sub-band representations a selection or sub-set of the synthetic lower frequency representations which best represents or 'matches' the higher frequency sub-band representation.

In some embodiments the searcher 305 is further configured to perform an initial pre-processing on the higher frequency sub-band representations, to assist in the speed of determining the matching. For example in some embodiments the searcher 305 can be configured to control the search by limiting the range of the lower frequency samples available for searching to a subset of the lower frequency components. In some embodiments the pre-processing on the higher frequency sub-band representations may be the same or different for each of the higher frequency sub-bands.

In the following described examples, the searcher 305 can pre-process the higher frequency sub-bands to exploit possible correlation between the lower frequency regions for each higher frequency sub-band selected. In other words the searcher 305 limits the range of lower frequency samples searched by determining the most 'representative' lower sub-band to be searched first. In other words if considering a first higher frequency sub-band and a second higher frequency sub-band which are adjacent in frequency, a lower frequency region providing a good match with the second higher frequency sub-band is likely to be found in the proximity of a lower frequency region found to provide a good match with the first higher frequency sub-band.

The searcher 305 can in some embodiments comprise a subset selector configured to select a subset of the lower frequency sub-band samples and a sub-series searcher configured to find a matching subseries for the subset of the lower frequency samples that is suitable for coding the higher frequency samples. The subset selector can in some embodiments select the subset dependent on the input higher frequency series of samples. In other words the subset can be dependent on the higher frequency sub-band index (j).

The sub-set selector can significantly reduce the number of calculations required compared to using the whole lower frequency component samples to determine the matching. The selection of the subset of the frequency components can use a predetermined methodology for selecting the subset. In some other embodiments of the subset selection may be carried out by one of a plurality of different methodologies.

The sub-set selector can in some embodiments achieve the reduced subset $\tilde{X}_L^j(k)$ by selecting the range of samples in the lower frequency range $\hat{X}_L$ that are most probably the perceptually most important.

The sub-set selector can in some embodiments determine a 'reference' higher frequency sub-band $X_H^j(k)$. The 'reference' higher frequency band in some embodiments can be determined by the sub-set selector as the lowest frequency higher frequency band e.g. j=0. This is because typically the lower frequency components of the higher frequency sub-bands are more relevant to producing high quality encoding.

However in some embodiments the sub-set selector can in some embodiments adaptively select the 'reference' higher frequency sub-band based on the characteristics of the higher frequency sub-bands. For example, in some embodiments a similarity measurement, such as a cross-correlation, can be applied by the sub-set selector to the higher frequency sub-bands to identify the higher frequency sub-band that has the greatest similarity to the other higher frequency sub-bands. In such embodiments the greatest similarity or 'reference' or representative higher frequency sub-band can be the higher frequency sub-band with the highest cross-correlation with another higher frequency sub-band. In some other embodiments the sub-set selector can determine the representative higher frequency sub-band as the higher frequency sub-band with the highest median or mean cross-correlation with the other higher frequency sub-bands.

The operation of determining the representative sub-band is shown in FIG. 5 by step 610.

The searcher 305, or in some embodiments the sub-series searcher can then be configured to processes the full lower frequency band or range $\hat{X}_L(k)$ and the representative higher frequency band $X_H^j(k)$ to identify a 'matching' reference sub-series of the frequency band or range $\hat{X}_L(k)$. The sub-series searcher in some embodiments can determine a matching parameter by defining a similarity cost function S(d), which can be mathematically represented as:

$$S(d) = \left| \frac{\sum_{k=0}^{n_j-1} \left( X_H^j(k) \hat{X}_L(d+k) \right)}{\sqrt{\sum_{k=0}^{n_j-1} \hat{X}_L(d+k)^2}} \right|$$

where $n_j$ is the length of the higher frequency sub-band and d is the index of the lower frequency range.

In some embodiments the searcher can be configured to, as well as determining the index d which maximises the similarity function, determine also a series of gain values to assist in the scaling approximations. For example in some embodiments a linear domain scaling gain $\alpha_1(j)$ can be determined as:

$$\alpha_1(j) = \frac{\sum_{k=0}^{n_j-1} \left(X_H^j(k)\hat{X}_L^j(k)\right)}{\sum_{k=0}^{n_j-1} \hat{X}_L(d+k)^2}.$$

Furthermore in some embodiments an energy and logarithmic domain scaling gain $\alpha_2(j)$ can be determined by the searcher 305.

$$\alpha_2(j) = \frac{\sum_{k=0}^{n_j-1} \left(\left(\log_{10}\left(\left|\alpha_1(j)\hat{X}_L^j(k)\right|\right) - M_j\right)\left(\log_{10}\left(\left|X_H^j(k)\right|\right) - M_j\right)\right)}{\sum_{k=0}^{n_j-1} \left(\log_{10}\left(\left|\alpha_1(j)\hat{X}_L^j(k)\right|\right) - M_j\right)^2}$$

$$\text{where } M_j = \max_k\left(\log_{10}\left(\left|\alpha_1(j)\hat{X}_L^j(k)\right|\right)\right).$$

The second encoding means may thus in some embodiments further comprise a scaling means for determining at least one scaling parameter configured to define a scaling between a section of the second part of the audio signal and a section of the first part of the audio signal, wherein the section of the first part of the audio signal may be the first part of the audio signal associated with the indicator for the first section of the second part of the audio signal. Wherein the at least one scaling parameter may comprise at least one of: a linear domain scaling parameter; and a logarithmic domain scaling parameter.

The apparatus may further comprise reference means for determining a reference section of the second part of the audio signal, wherein the first section of the second part of the audio signal is selected as the reference section.

The overall synthesized sub-band $\hat{X}_H^j(k)$ can therefore be determined in the decoder from the above values as $\hat{X}_H^j(k)=\zeta(k)10^{\alpha_2(j)(log_{10}(|\alpha_1(j)\hat{X}_L^j(k)|)-M_j)+M_j}$ where $\zeta(k)$ is −1 if $\alpha_1(j)\hat{X}_L^j(k)$ is negative and otherwise 1.

Consequently a full or exhaustive search of the lower frequency values using the reference higher frequency sub-band in such embodiments produces a reference sub-series within the lower frequency samples for searching. In other words for the non reference or relevant higher frequency sub-bands the search is started in the neighborhood of the lower frequency sub-series defined by $\hat{X}_L(d_{max})$.

The sub-series searcher can be configured to further define a search ranges SR which defines the number of search positions from the reference matched lower frequency range. The number of search positions in some embodiments can be for example, between 30% and 150% of the size of the sub-band. However any suitable search range can be used in some embodiments.

The searcher 305 can in some embodiments be configured to then output the high frequency sub-band match index and gain values or any other suitable scaling parameters to a higher frequency region low bitrate extension coder 307.

The operation of searching the lower frequency region for matches for higher frequency sub-bands and specifically the searching for a match for the representative or reference higher frequency sub-band first and using the results from this search to assist the other searches is shown in FIG. 5 by step 611.

In some embodiments the HFR coder comprises higher frequency region low bitrate extension coder 307 configured to receive the index, gain and other scaling parameters (which can also be known as match parameters) representing the higher frequency region sub-bands and generate a low bit rate extension coding. In other words there can be in some embodiments a second encoding means for encoding the second part of the audio signal to generate a second encoded audio signal comprising for a first section of the second part an indicator to at least part of the first part of the audio signal.

The higher frequency region low bitrate extension coder 307 in some embodiments comprises an index divider 309. The index divider 309 is configured to divide the searched match parameters into two groups, a first group which is configured to be index encoded and a second group which is non-index encoded.

In some embodiments the index divider 309 is configured to perform the division using a fixed or determined process. For example where there are L higher frequency sub-bands the first J higher frequency sub-bands are determined to be index coded and the remaining L-J sub-bands are determined to be non-index encoded, where J is a fixed value. In some other embodiments the index divider is adaptive and dependent on the bitrate used or bit-rate capacity the value of J can change from frame to frame. In some embodiments the index divider can receive network or control information to adjust the value of J dependent on the network capacity or bit-rate generated from other parts of the encoder. In some embodiments the index divider 309 is configured to determine the lower frequency higher frequency sub-bands as being index encoded and the higher frequency sub-bands as being non-index encoded. In some further embodiments the index divider 309 can be configured to receive from the searcher the output of the search for a representative higher frequency sub-band and determine the most representative higher frequency sub-bands as being suitable for index encoding and the less representative higher frequency sub-bands as suitable for non-index encoding.

The index divider 309 is in such embodiments configured to pass the match parameters for index encoding to the quantizer 311 and the match parameters for non-index encoding to the initial position/point selector 315. In other words in some embodiments there are processing means for determining the first section of the second part of the audio signal such that the first encoded audio signal and second encoded audio signal is within a defined encoding efficiency parameter.

The operation of dividing the HFR sub-bands into index and non-index encoded forms is shown in FIG. 5 by step 613.

The higher frequency region low bit rate extension coder 307 in some embodiments comprises a quantizer 311. The quantizer 311 is configured to receive the match parameters for index encoding and generate suitable quantised outputs to be passed to the multiplexer 317 and represent the match parameters for the higher frequency region sub-bands.

The operation of outputting quantized values is shown in FIG. 5 by step 614.

In some embodiments the code generator passes the gain values associated with the non-index coded sub-bands which are furthermore multiplexed by the multiplexer 317.

The quantized index and other gain or scaling parameters can then be multiplexed by the multiplexer 317 before being output as a higher frequency coder 232 output to a bitstream formatter 234.

The bitstream formatter 234 receives the lower frequency coder 231 output, the higher frequency region coder 232 output and formats the bitstream to produce the bitstream output. The bitstream formatter 234 in some embodiments of the invention may interleave the received inputs and may generate error detecting and error correcting codes to be inserted into the bitstream output 112.

The step of multiplexing the HFR coder 232 and LFR coder 231 information into the output bitstream is shown in FIG. 5 by step 617.

The apparatus therefore in some embodiments may further comprise combining means for combining the first encoded audio signal and the second encoded audio signal.

The apparatus in some embodiments further comprises data storage means for storing a combined first encoded audio signal and second encoded audio signal.

The apparatus in some embodiments further comprises transmitting means for transmitting a combined first encoded audio signal and second encoded audio signal.

To further assist the understanding of the application the operation of the decoder 108 with respect to the some embodiments is shown with respect to the decoder schematically shown in FIG. 6 and the flow chart showing the operation of the decoder in FIG. 7.

The decoder in some embodiments comprises an input 413 from which the encoded bitstream 112 may be received. The apparatus can for example in some embodiments comprise receiving means configured to receive an encoded audio signal.

The decoder 108 furthermore in some embodiments comprises a bitstream unpacker 401 configured to receive the input 413.

The bitstream unpacker 401 in such embodiments demultiplexes, partitions, or unpacks the encoded bitstream 112 into three separate bitstreams. The lower frequency encoded bitstream is in these embodiments passed to a lower frequency region decoder 403, the higher frequency bitstream index values are passed to a higher frequency sub-band index decoder 405 and to a higher frequency region decoder 407.

This unpacking process is shown in FIG. 7 by step 701.

In some embodiments the decoder 108 comprises a lower frequency region decoder 403. The lower frequency region decoder 403 receives the lower frequency encoded data and constructs a synthesized lower frequency signal by performing the inverse process to that performed in the lower frequency region coder 231. This synthesized low frequency signal is in some embodiments passed to the higher frequency region decoder 407 and to the reconstruction decoder 409. In other words in some embodiments there is a first decoding means configured to decode from a first part of an encoded audio signal a first audio signal.

This lower frequency region decoding process is shown in FIG. 7 by step 707.

The decoder 108 in some embodiments comprises a higher frequency sub-band index decoder 405 which receives higher frequency bitstream index values from the bitstream unpacker 401 and generates reconstructed index values for the index coded sub-bands. The reconstructed index values in some embodiments are passed to the higher frequency region index generator 406 and the higher frequency region decoder 407. In other words in some embodiments there is a second decoding means configured to decode from a second part of the encoded audio signal at least one indicator referencing at least a part of the first audio signal for generating a second audio signal.

The operation of decoding the higher frequency sub-band values is shown in FIG. 7 by step 703.

The decoder 108 in some embodiments comprises a higher frequency sub-band index generator 406. The higher frequency sub-band index is configured to generate sub-band index values for the non-index coded sub-bands. In other words in some embodiments there is an indicator generating means configured to generate at least one further indicator dependent on at least one indicator, the at least one further indicator referencing at least a part of the first audio signal for generating a third audio signal.

The higher frequency sub-band index generator 406 in some embodiments further comprises an initial point selector configured to receive the decoded higher frequency sub-band index values and generate an initial non-index encoded sub-bands value. The initial point selector is configured to select an initial value which represents an index of the lower frequency region to be used to represent the non-index coded higher frequency sub-band. In some embodiments the index selected by the initial point selector can be the index representing the representative or reference higher-frequency sub-band. In some embodiments of the initial point selector can be configured to select a fixed index. For example in some embodiments the fixed index can be an index of zero. The initial point selected index generated by the initial point selector can then be passed to the code generator. In other words the indicator generating means may comprise: an initial determiner means for determining an initial further indicator value.

As indicated here the initial determiner means may comprise in at least one embodiment: a reference value means for decoding from a reference second part of the encoded audio signal a reference indicator value; and initial value selector means for determining the initial further indicator value as the reference indicator value.

Furthermore the at least one initial further indicator value may be at least one of: a static value; and an adaptive value.

The operation of selecting the initial point is shown in FIG. 7 by step 704.

The higher frequency region sub-band index generator 406 in some embodiments further comprises a code generator configured to receive the initial index or point selection from the initial point selector and furthermore in some embodiments at least some of the regenerated or decoded quantized sub-band index values from the higher frequency region index decoder 405. In other words there can be in at least one embodiment a value determiner means configured to determine the further indicator value dependent on a combination indicator value from at least two indicator values decoded from the second part of the encoded signal.

The code generator having received the initial point index is configured to perform a deterministic randomisation of the sub-band index value selected. In some embodiments the deterministic pseudo-randomization of the initial point select index value can be any suitable pseudorandom index generation. For example the initial index value can be used as a seed value in a suitable known pseudorandom process or function such as the uniform process. Furthermore in some embodiments the code generator performs a non-linear deterministic process on the initial point selector index value to generate a pseudorandom value. In some further embodiments the code generator performs a deterministic chaotic function on the value index generated by the initial point selector.

In some embodiments the code generator can be configured to generate a pseudo-randomization of the initial point selector index value based on at least one sub-band index value output via the higher frequency sub-band index decoder 405.

Thus in a first example sub-band index values generated by the higher frequency sub-band index decoder 405 can be averaged to generate a shift value to be applied to the initial point selected index. Thus for example where the first three sub-band index values generated from the higher frequency sub-band index decoder 405 have the indices 10, 34 and 25 the code generator can in some embodiments average the values to generate a shift value of 23 which then can be used as a shift value applied to the initial point select index value, for example zero, to generate a sub-band index value for the current frame non-index value of 23.

Thus in one embodiments the indicator generating means may comprise indicator processing means for generating an average value of the at least two indicator values decoded from the second part of the encoded signal. Furthermore in some embodiments the indicator generating means may comprise an weighted indicator means for generating a weighted averaging of the at least two indicator values decoded from the second part of the encoded signal.

In some embodiments, for example where the most representative region is used to produce the initial point selector index value there can be an additional offset such that the current frame can output a sub-band index generated by the code generator shift and the initial point selector. Thus for example where the most representative region generates an index of 32 for the current frame and the next three sub-band indices are 10, 34 and 25 as described above the current frame sub-band index for the non-index values can be 32+23=55. In other words a combiner means can determine the further indicator value by combining the initial further indicator value with the combination indicator value.

The sub-band content for the sub-bands can in some embodiments be obtained by combining the content of one or more sub-bands. Although the above example describes averaging the sub-band values other combinations which are suitable can be used. The averaging for example in some embodiments modifies the sub-band content by generating a more uniform (in other words more like random noise) output. This in some embodiments has the benefit of removing unwanted artefacts which may sometimes be generated due to randomly selected sub-bands being unoptimal or repetitive. In some embodiments the combination of sub-bands indices may themselves be weighted such to give a higher weight for the randomly selected subbands than other subbands. The generated sub-band index values can be passed to the higher frequency region decoder 407.

The generation of higher frequency sub-band index values for the non-index coded values from other index coded values is shown in FIG. 7 by step 705.

The HFR decoder 407 in these embodiments performs the inverse to the suppressed high frequency encoder 307. For example the HFR decoder in some embodiments replicates and scales the low frequency components from the synthesized low frequency signal as indicated by the high frequency reconstruction bitstream in terms of the bands indicated by the band selection information.

This high frequency suppressed replica construction is shown in FIG. 7 by step 706.

The reconstructed high frequency component bitstream in some embodiments is passed to the reconstruction decoder 409.

The reconstruction decoder 409 receives the decoded low frequency bitstream and the reconstructed high frequency bitstream to form a bitstream representing the original signal and outputs the output audio signal 114 on the decoder output 415. Therefore in some embodiments there is a combining means configured to combine the first, second and third audio signals to generate a decoded audio signal.

This reconstruction of the signal is shown in FIG. 11 by step 711.

The embodiments of the invention described above describe the codec in terms of separate encoders 104 and decoders 108 apparatus in order to assist the understanding of the processes involved. However, it would be appreciated that the apparatus, structures and operations may be implemented as a single encoder-decoder apparatus/structure/operation. Furthermore in some embodiments of the invention the coder and decoder may share some/or all common elements.

Although the above examples describe embodiments of the invention operating within a codec within an apparatus 10, it would be appreciated that the invention as described below may be implemented as part of any audio (or speech) codec, including any variable rate/adaptive rate audio (or speech) codec. Thus, for example, embodiments of the invention may be implemented in an audio codec which may implement audio coding over fixed or wired communication paths.

Thus user equipment may comprise an audio codec such as those described in embodiments of the invention above.

It shall be appreciated that the term user equipment is intended to cover any suitable type of wireless user equipment, such as mobile telephones, portable data processing devices or portable web browsers.

Furthermore elements of a public land mobile network (PLMN) may also comprise audio codecs as described above.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

Thus at least some embodiments of the encoder may be an apparatus comprising at least one processor and at least one memory including computer program code the at least one memory and the computer program code configured to, with the at least one processor, cause the apparatus at least to perform: determining at least one event from at least one audio signal, wherein the event comprises a region of frequency components of the at least one audio signal; generating a suppressed at least one audio signal by suppressing the at least one event from the at least one audio signal; and encoding at least one event from the at least one event.

In some embodiments of the decoder there may be an apparatus comprising at least one processor and at least one memory including computer program code the at least one memory and the computer program code configured to, with the at least one processor, cause the apparatus at least to perform: receiving at least one indicator representing at least one frequency component event from a region of frequency components; and modifying at least one frequency component within the at least one event dependent on the indicator.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions.

Thus at least some embodiments of the encoder may be a computer-readable medium encoded with instructions that, when executed by a computer perform: determining at least one event from at least one audio signal, wherein the event comprises a region of frequency components of the at least one audio signal; generating a suppressed at least one audio signal by suppressing the at least one event from the at least one audio signal; and encoding at least one event from the at least one event.

Furthermore at least some of the embodiments of the decoder may be provided a computer-readable medium encoded with instructions that, when executed by a computer perform: receiving at least one indicator representing at least one frequency component event from a region of frequency components; and modifying at least one frequency component within the at least one event dependent on the indicator.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising:

filtering, by executing on a processor, an audio signal into a lower frequency region and a higher frequency region;

encoding, by executing on a processor, the lower frequency region with a first encoder for generating a first encoded audio signal;

encoding, by executing on a processor, the higher frequency region with a second encoder configured to generate a second encoded audio signal by:

determining, by executing on a processor, a higher frequency region reference comprising a range of frequencies of the higher frequency region;

processing, by executing on a processor, the lower frequency region and the higher frequency region reference section to determine an index for a sub section of frequencies of the lower frequency region which best matches the higher frequency region reference;

processing, by executing on a processor, at least one further range of frequencies of the higher frequency region to determine at least one further index of a further sub section of frequencies of the lower frequency region by searching further ranges of frequencies of the lower frequency region, wherein the searching is based on the index for the sub section of frequencies; and determining, by executing on a processor, a first group of indices from the index and the at least one further index such that the first encoded audio signal and second encoded audio signal is within a defined encoding efficiency parameter.

2. The method as claimed in claim 1, wherein the encoding efficiency parameter comprises at least one of:

a bitrate;

a bandwidth; and an encoded audio signal size to audio signal size ratio.

3. The method as claimed in claim 1, further comprising:

combining the first encoded audio signal and the second encoded audio signal; and either storing the combined first encoded audio signal and second encoded audio signal or transmitting the combined first encoded audio signal and second encoded audio signal.

4. The method as claimed in claim 1, wherein the second encoded audio signal further comprises:

a scaling parameter configured to define a scaling between the frequencies of the higher frequency region reference and the sub section of frequencies of the lower frequency region indicated by the index; and at least one further scaling parameter configured to define a scaling between the at least one further range of frequencies of the higher frequency region and the further sub section of frequencies of the lower frequency region indicated by the at least one further index, wherein the at least one further index is a member of the first group of indices.

5. The method as claimed in claim 4, wherein the scaling parameter and the at least one further scaling parameter comprises at least one of:

a linear domain scaling parameter; and a logarithmic domain scaling parameter.

6. The method as claimed in claim 1, wherein determining the higher frequency region reference comprises:

dividing frequencies of the higher frequency region into a plurality of sections;

determining for each of the plurality of sections a cross-correlation value between each combination of the plurality of sections; and selecting as the higher frequency region reference the section with the largest average cross-correlation value.

7. An apparatus comprising at least one processor and at least one memory including computer program code the at least one memory and the computer program code configured to, with the at least one processor, cause the apparatus at least to:

filter an audio signal into a lower frequency region and a higher frequency region;

encode the lower frequency region with a first encoder for generating a first encoded audio signal;

encode the higher frequency region with a second encoder configured to generate a second encoded audio signal by causing the apparatus to:

determine a higher frequency region reference comprising a range of frequencies of the higher frequency region;

process the lower frequency region and the higher frequency region reference section to determine an index for a sub section of frequencies of the lower frequency region which best matches the higher frequency region reference;

process at least one further range of frequencies of the higher frequency region to determine at least one further index of a further sub section of frequencies of the lower frequency region by searching further ranges of frequencies of the lower frequency region, wherein the searching is based on the index for the sub section of frequencies; and determine a first group of indices from the index and the at least one further index such that the first encoded audio signal and second encoded audio signal is within a defined encoding efficiency parameter.

8. The apparatus as claimed in claim 7, wherein the encoding efficiency parameter comprises at least one of:

a bitrate;

a bandwidth; and an encoded audio signal size to audio signal size ratio.

9. The apparatus as claimed in claim 7, further caused to:

combine the first encoded audio signal and the second encoded audio signal; and either store the combined first encoded audio signal and second encoded audio signal or transmit the combined first encoded audio signal and second encoded audio signal.

10. The apparatus as claimed in claim 7, wherein the second encoded audio signal further comprises:

a scaling parameter configured to define a scaling between the frequencies of the higher frequency region reference and the sub section of frequencies of the lower frequency region indicated by the index; and at least one further scaling parameter configured to define a scaling between the at least one further range of frequencies of the higher frequency region and the further sub section of frequencies of the lower frequency region indicated by the at least one further index, wherein the at least one further index is a member of the first group of indices.

11. The apparatus as claimed in claim 10, wherein the scaling parameter and the at least one further scaling parameter comprises at least one of:

a linear domain scaling parameter; and a logarithmic domain scaling parameter.

12. The apparatus as claimed in claim 7, wherein the apparatus caused to determine a reference section is further caused to:

divide frequencies of the higher frequency region into a plurality of sections;

determine for each of the plurality of sections a cross-correlation value between each combination of the plurality of sections; and select as the higher frequency region reference the section with the largest average cross-correlation value.

* * * * *